United States Patent [19]

Stritzke

[11] Patent Number: 4,697,766

[45] Date of Patent: Oct. 6, 1987

[54] DEVICE FOR ASCENDING AND DESCENDING A KITE STRING

[76] Inventor: Gerd O. Stritzke, Rock Lake, Highway O, Winchester, Wis. 54567

[21] Appl. No.: 821,152

[22] Filed: Jan. 21, 1986

[51] Int. Cl.[4] ..... B64C 31/06

[52] U.S. Cl. ..... 244/155 R

[58] Field of Search ..... 244/155 R, 155 A, 153 R, 244/154

[56] References Cited

U.S. PATENT DOCUMENTS

| | | | |
|---|---|---|---|
| 985,301 | 2/1911 | Terry | 244/155 R |
| 2,598,030 | 5/1952 | Bird | 244/155 R |
| 2,785,871 | 3/1957 | Flint et al. | 244/155 R |
| 3,687,403 | 8/1972 | Guinn | 244/155 R |
| 3,960,347 | 6/1976 | Stritzke | 244/155 R |

*Primary Examiner*—Jeffrey V. Nase
*Assistant Examiner*—Rodney Corl
*Attorney, Agent, or Firm*—Willian Brinks Olds Hofer Gilson & Lione, Ltd.

[57] ABSTRACT

A device is disclosed for ascending a kite string responsive to wind pressure. The device is adapted to ascend the kite string until a stop affixed to the kite string is engaged by a trigger on the device which releases the wings from their ascending position and allows them to pivot toward the kite whereby the device descends the kite string. An important feature of the invention is the fact that the trigger includes an aperture running longitudinally therethrough which is adapted to receive the kite string.

18 Claims, 10 Drawing Figures

FIG. 1
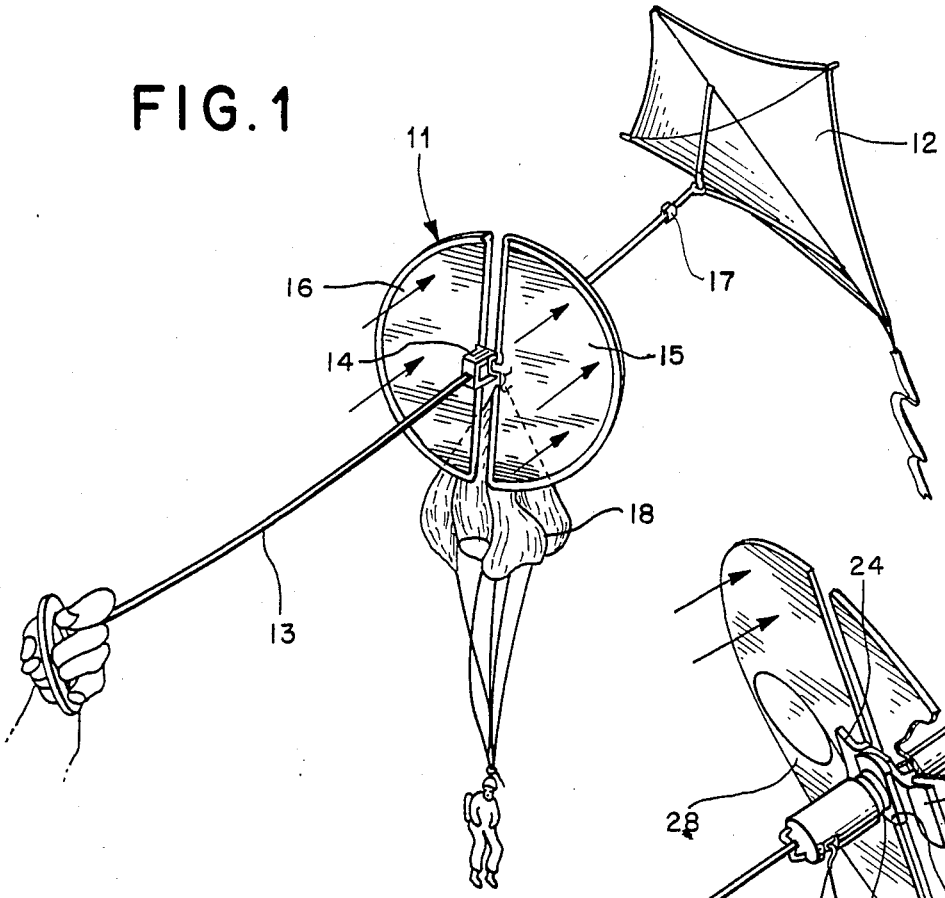
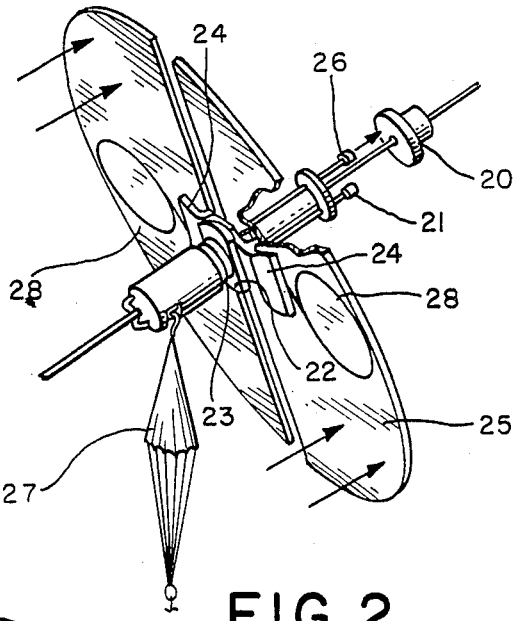
FIG. 2
(PRIOR ART)
FIG. 4
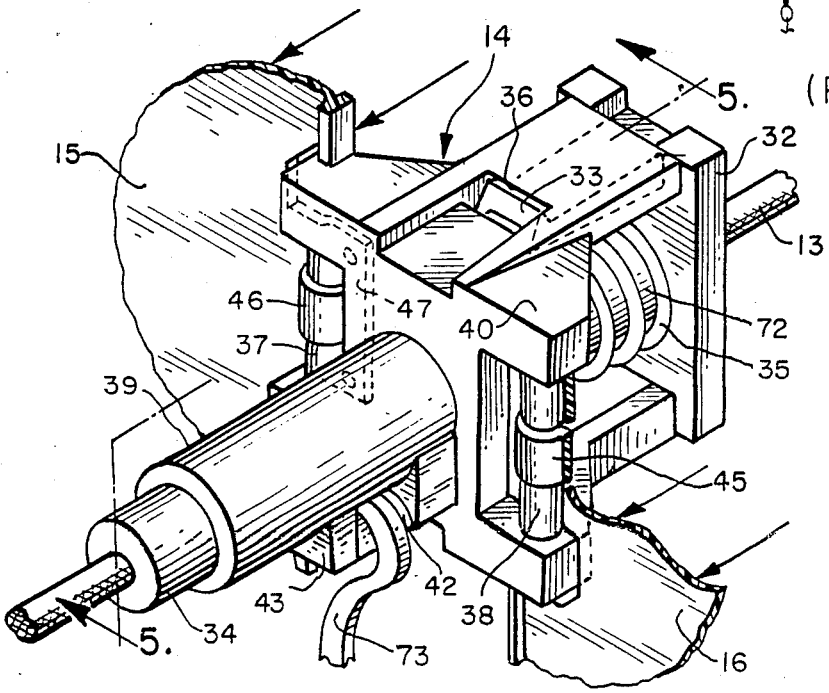

DEVICE FOR ASCENDING AND DESCENDING A KITE STRING

BACKGROUND OF THE INVENTION

This invention relates to attachments for kites and the like, and more particularly to a device for ascending a line toward a kite, balloon, or the like, which device is also designed to descend after it has reached a predetermined point on the line.

Kite accessories of various types have been developed in the past, several of which are designed to ascend a kite string responsive to wind pressure. Many of the earlier designs involve the use of hangers to attach the device to the kite string together with wings which are held transverse to the kite string during ascension and then allowed to fold parallel to the string for descension.

Improvements to these earlier designs were disclosed in U.S. Pat. No. 3,960,347 to the present inventor, the entire disclosure of which is incorporated herein by reference. Therein, the advantage of using two semi-circular wings to inhibit rotation of the device was reported. The advantages of passing the string directly through the device were described in the inventor's earlier patent. It was stated that this would overcome the problem of the earlier device that have separate hangers which may become entangled with the kite string.

The device described in the inventor's patent referred to above is illustrated herein at FIG. 2. As shown, the means for releasing the wings from the ascending position, i.e. transverse to the string, comprises two rods 21 which contact a stop 20 affixed to the kite string. On contacting the stop, the rods push the flanged portion 22 of the sleeve 23 away from the back side of the wing supports 24. As a result, the wing supports are allowed to pivot responsive to the wind pressure against the wings 25, which are attached to the supports 24 via wires 28, so that the wings can thus be pushed back to a position generally parallel to the string. With the wings in this position, the device descends the string responsive to gravity. A third rod 26 is also provided as a means to release an object, such as a parachute 27, upon hitting the stop 20.

The inventor has observed certain problems with the above-described design. First, the inventor found that with his earlier design, it was important to have two rods to release the wings. This was so because, if only one rod were provided, the device would be subject to an as symmetrical force when the single rod contacted the stop on the string. This force would tend to push the device off of its longitudinal axis, thus interfering with the operation of the device. In addition, a relatively large stop placed on the string was necessary in order to ensure that neither rod missed engaging the stop. Naturally, a larger stop is a disadvantage due to increased weight.

Second, if the earlier device encountered a knot in the string, the device would stop ascending. However, the push rods would not be engaged so the device would not be allowed to descend. As a result, the earlier device could become stuck part way up the kite string.

Third, the inventor has found that the earlier design did not lend itself particularly well to economical and efficient mass production. It is recognized that the most common use for such a device is as a toy. Accordingly, the cost of such a device must be relatively low in order to gain market acceptance. Certain of the parts of this earlier design, however, were required to be made from metal rather than a more economical and lighter material such as plastic. Moreover, the earlier design of the device did not lend itself to easy assembly by the end user. As a result, the device was not as popular as it might have been had it been capable of more economical manufacture.

Fourth, the inventor observed that the design was not as durable as might be otherwise possible. For example, the relatively thin rods called for in the earlier design could be bent through improper use, thus rendering the device inoperable. Also, because the wings had to be attached to the supports, it was possible for the wings to fall off the device during use.

Finally, the inventor found that it was not advantageous to retain the object to be released in front of, i.e. upwind of, the wings. This presented the problem that the wind could blow the parachute, or the like, into the wings and thus interfere with their operation.

SUMMARY OF THE INVENTION

Accordingly, the object of the present invention is to provide an improved device for ascending a string toward a kite or the like which device also descends the string after attaining a predetermined point on the string. More particularly, it is an object of the present invention to provide such a device which is more economical to produce and also is more durable than the prior art devices.

Briefly stated, the present invention comprises stop means attached to the kite string, housing means, and wing means hingedly attached to the housing means and adapted to pivot between an ascending position generally transverse to the kite string, and a descending position generally parallel to the kite string. The device further comprises trigger means for releasing the wing means from the ascending position in response to engaging the stop means, thereby allowing the wings to pivot to the descending position. In addition, the trigger means defines an aperture running longitudinally therethrough which is adapted to receive the kite string.

The inventor has found that employing a trigger means which has the kite string passing longitudinally therethrough provides important advantages. In particular, the inventor found that with this improvement, only one trigger means is required because engaging the trigger means situated on the kite string will not tend to push the device off its longitudinal axis. In addition, because the trigger means is on the kite string, the stop means can be made smaller as there is no chance that the trigger means could miss it. Moreover, because the trigger means slides on the string itself, if the device encounters a knot in the string which is too large to fit through the aperture, the trigger is activated and the device is allowed to descend. As a result, the device is prevented from getting stuck.

In accordance with one embodiment of the present invention, the device comprises a housing means with a longitudinal axis generally parallel to the kite string and having a base portion and an aperture running parallel to the longitudinal axis. Two wings are hingedly connected to the base portion of the housing means so that each wing can pivot between an ascending position wherein the wing is generally transverse to the kite string, and a descending position wherein the wing is generally parallel to the kite string and folded toward the kite. A trigger means also is provided having an aperture running therethrough to receive the kite string. The trigger means also comprises an elongate portion which is inserted within the aperture of the housing means and is adapted to slide therein. The elongate portion is longer than the aperture in the housing means and as such an end of the elongate portion extends beyond the housing means toward the kite when the elongate portion is fully inserted in the aperture of the housing means. Means for biasing the trigger means toward the kite and biasing the elongate portion into the aperture of the housing means is provided so as to push the trigger means into a position which will retain the wings in the ascending position. Stop means for engaging the extending end of the elongate portion is also provided. When the device is pushed against the stop means, the trigger means is stopped while the housing means continues to move toward the kite whereby the trigger means, in a relative sense, is pushed back into the housing means. When the trigger means is so moved, it causes the wings to be released from their ascending position and allows the wind pressure to push the wings into the descending position.

In the preferred embodiment, the device further comprises means for releasing an object, such as a parachute, in response to contacting the stop means.

BRIEF DESCRIPTION OF THE DRAWINGS

The present invention will be more clearly understood from the following detailed description of the specific embodiments, read in conjunction with the accompanying drawings, wherein:

FIG. 1 is a perspective view of the preferred embodiment of the invention being used with a conventional kite.

FIG. 2 is a perspective view of a prior art device.

FIG. 4 is a perspective view of the preferred embodiment.

Figure 3:
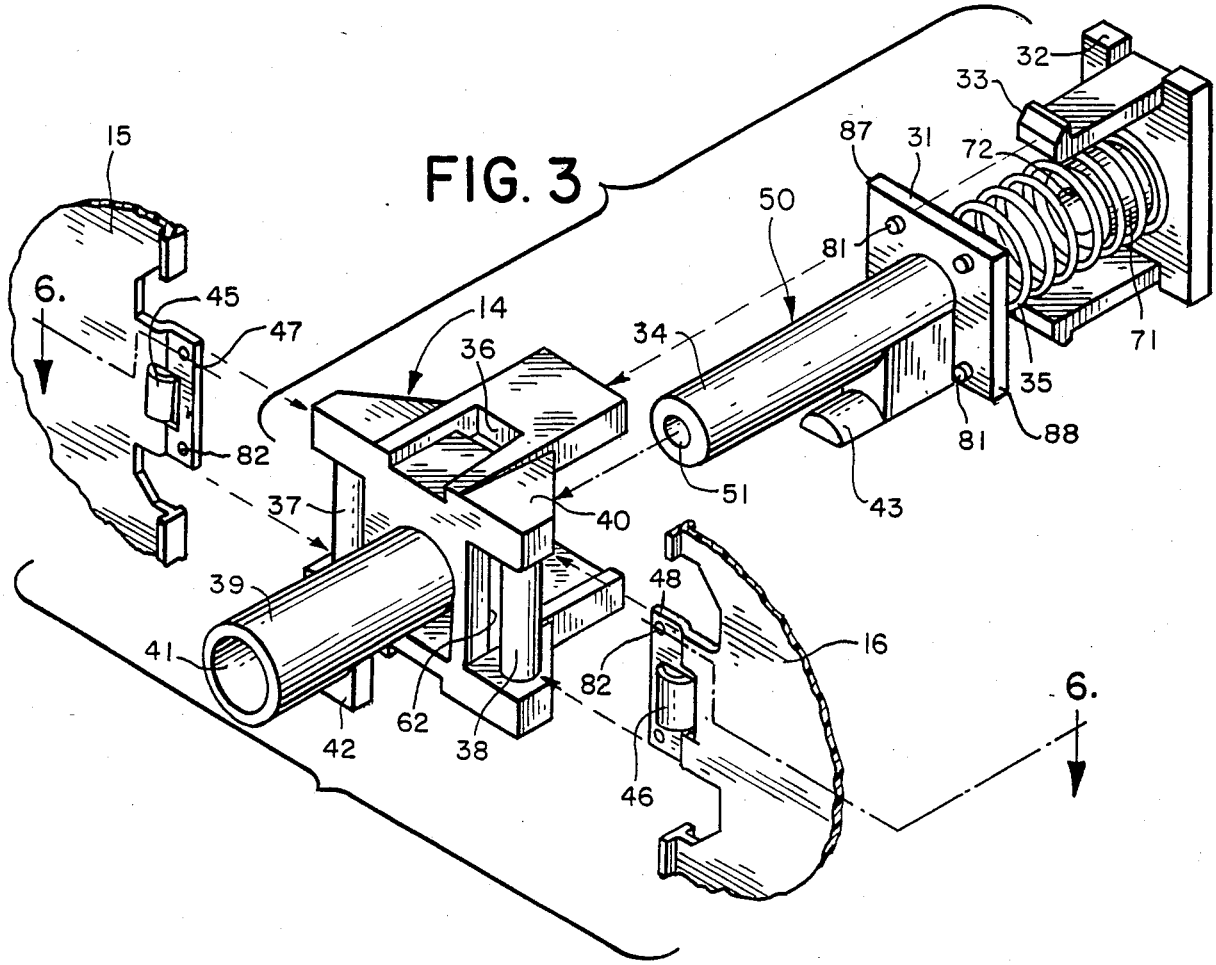
FIG. 3 is an exploded perspective view showing the individual parts of the preferred embodiment.

FIGS. **8–8*b*** illustrate the preferred construction of the stop means.

DETAILED DESCRIPTION

Referring to FIG. 1, the device of the present invention, generally 11, is used in combination with kite 12 which is being controlled by string 13. As used herein the term "kite" refers to any type of device which rises in the air and has a string attached for maintaining control over the device. Kites come in many traditional and non-traditional shapes and sizes. Some kites are constructed with wooden or plastic frames over which a material is stretched, while other kites, such as inflatable kites, have other constructions. The inventor intends the word kite to also refer to balloons filled with hot air or helium which are "flown" with a string attached. The device of the present invention may be used with any of these types of kites. In addition, the term "string" is intended to all types of string or line, such as conventional string, nylon line, etc., which can be used to control a kite.

The device 11 comprises two wings 15 and 16 which are hingedly attached to the housing means 14. Preferably, the wings are each semi-circular in shape. An aperture adapted to receive the string 13 runs parallel to the longitudinal axis and through the entire device 11. The device also comprises a stop means which is affixed at a predetermined point on the string 13, preferably near the kite.

Although not present in all embodiments, the preferred embodiment also includes a means for releasing an object, such as a parachute 18, in response to contacting the stop means 17. Other objects, such as toy airplanes or helicopters, can likewise be carried up with the device and released at a point near the kite. It is important to note that in the preferred embodiment the object 18 is attached to the device at a point closer to the kite than the wings 15 and 16. In other words, the object 18 is downwind from the wings 15 and 16. This has proven to be advantageous in preventing the object from interfering with the operation of the wings during ascension.

FIG. 3 shows each of the pieces of the device 11, while FIG. 4 shows how each of these pieces can be assembled to make the preferred embodiment. Preferably, these parts, with the exception of the spring 35, are made from an ordinary plastic. Most preferably, all of the parts except the spring and the wings are molded in a single operation from the same plastic. Because all of these pieces snap together, the device may be sold in pieces and easily assembled by the end user. As a result, this most preferred embodiment can be mass produced at a relatively low cost. Selection of the appropriate plastic is deemed within the ordinary skill in the art.

The housing means, generally 14, comprises a base portion 40. The wings 15 and 16, which for convenience are shown here only partially, can be hingedly attached to the base portion 40 by snapping the hinges 45 and 46 on the wings over the posts 37 and 38 respectively. Proximate to the hinges 45 and 46 are the tabs 47 and 48, respectively, Tabs 47 and 48 are adapted to contact the shoulder surfaces 61 and 62 (See FIGS. 6 and 7) of the housing means 14 when the wings 15 and 16 are pivoted into their ascending position, i.e. transverse to the kite string. The housing means 14 also comprises a sleeve portion 39 which has an aperture 41 passing therethrough.

The trigger means, generally 50, comprises an elongate portion 34 which is shaped and sized to slide within the aperture 41 of the sleeve portion 39. Preferably, the elongate portion 34 is cylindrically shaped and slides freely and without much wobble within a cylindrically shaped aperture 41 in the housing means 14. In alternative embodiments, the trigger means and the aperture in the housing means can take on different shapes, such as a rectangular prism. In addition, the elongate portion 34 is longer than the aperture 41 so that when fully inserted in the aperture, an end of the elongate portion 34 extends beyond the end housing sleeve portion 39 (See FIGS. 4, 5, and 6).

An important feature of the present invention is the fact that the trigger means 50 comprises an aperture 51 running longitudinally therethrough which is adapted to receive the kite string 13. In this way, the trigger means is adapted to engage the stop 17 without subjecting the device 11 to asymmetrical forces which would tend to push the device off its longitudinal axis. In addition, because the trigger means 50 slides on the kite string 13, the stop 17 can be made smaller since the trigger means 50 cannot miss engaging it. Furthermore, if the device encounters a knot in the string which is too large to pass through the aperture 51, the trigger means is activated and the device is allowed to descend. Preferably, the aperture 51 in the trigger means 50 passes through its center.

The trigger means 50 of this embodiment also comprises a flanged portion 31. The two sides of the flanged portion 31 are adapted to contact the back side of the tabs 47 and 48 of the wings and thereby push the wings against the shoulder surfaces 61 and 62 of the base portion 40 of the housing means 14. Preferably, the flanged portion 31 has bumps or pins 81 on its side surfaces to thereby index with the corresponding holes 82 in the tabs 47 and 48. Most preferably, each tab has two holes 82 while each side of the flanged portion 31 has two pins 81. The inventor has found that using such pins and holes is an important advantage in that the wings are thereby locked into their ascending positions, even in the face of strong winds.

Means for biasing the trigger means 50 into the housing means 14 and toward the kite 12 is provided in this preferred embodiment by spring 35 which is compressed against the back end of the trigger means 50. The frame member 32 is adapted to hold the spring in position when its tabs 33 are snapped into the slots 36 on the housing means 14. The frame member includes a cylinder 71 which retains the spring 35. An aperture 72 is included through the frame member to allow the kite string 13 to pass therethrough.

This embodiment also includes means for releasing an object in response to engaging the stop means. The trigger means 50 has a rod 43 attached near the flanged portion 31. This rod 43 contact the tab 42 when the trigger means 50 is fully inserted into the housing means 14. As a result, a closed loop is formed and the hook 73 or eye of an object can be retained on the device. When the trigger means is pushed back relative to the housing means in response to engaging the stop means, the loop is opened and the object is released from the device. It is preferred to locate the means for releasing an object closer to the kite than the wings, i.e. downwind from the wings. In this way, the object should not interfere with the operation of the wings during ascension.

Figure 5:
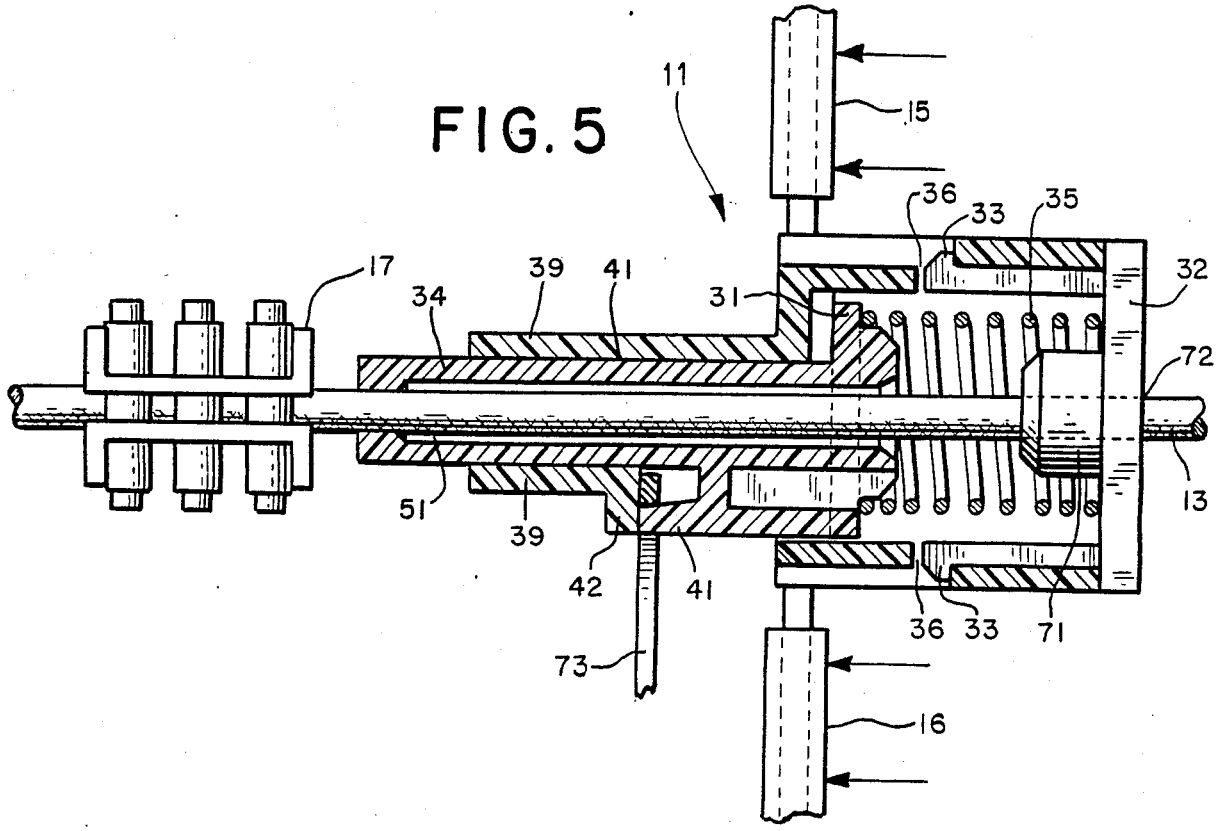
FIG. 5 is a cross-sectional view taken along line 5—5 of FIG. 4.

FIG. 5 is a vertical cross-sectional view of the preferred embodiment taken along line 5—5 of FIG. 4. As can be seen, the stop means 17 is clamped onto the string 13. The remainder of the device 11 is mounted slidably on the string 13. Specifically, the string is made to pass through the aperture 51 of the trigger means 50 and also through the aperture 72 in the frame member 32.

Figure 6:
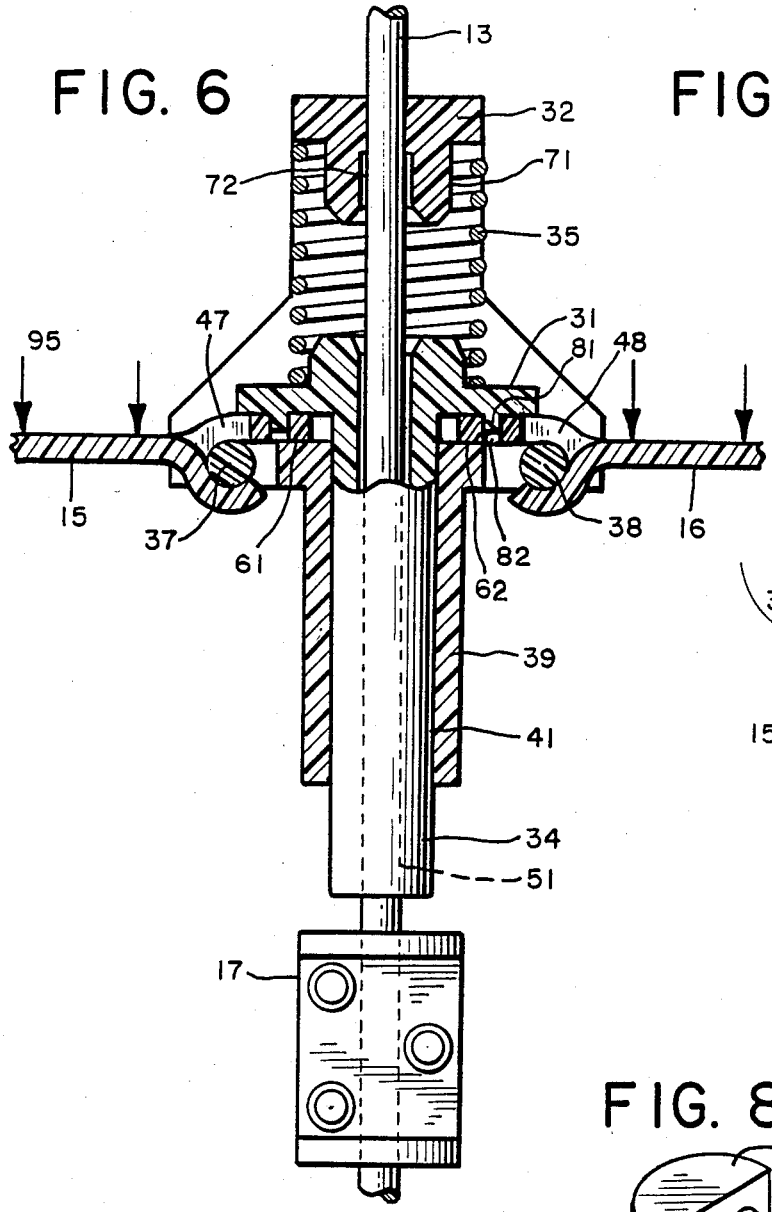
FIG. 6 is a cross-sectional view taken along line 6—6 of FIG. 3.

FIG. 6 is a horizontal cross-sectional view of the preferred embodiment taken along line 6—6 of FIG. 3. In this FIGURE, the wings 15 and 16 are retained in their ascending position, i.e. transverse to the kite string 13. This is accomplished in the following manner. First, the trigger means 50 is pushed back into the housing means 14 so that the flanged portion 31 is brought away from the base portion 40 of the housing means. At this point, the wings are pivoted so that the tabs 47 and 48 are adjacent to the shoulder surfaces 61 and 62 respectively of the housing means 14. The trigger means is then allowed to be pushed by the spring 35 further into the aperture 41 of the housing means until the sides of the flanged portion 31 contact the back sides of the tabs 47 and 48. Preferably bumps or pins 81 on the flanged portion 31 fit into the holes 82 on the tabs to better hold the tabs against the shoulder surfaces 61 and 62.

Figure 7:
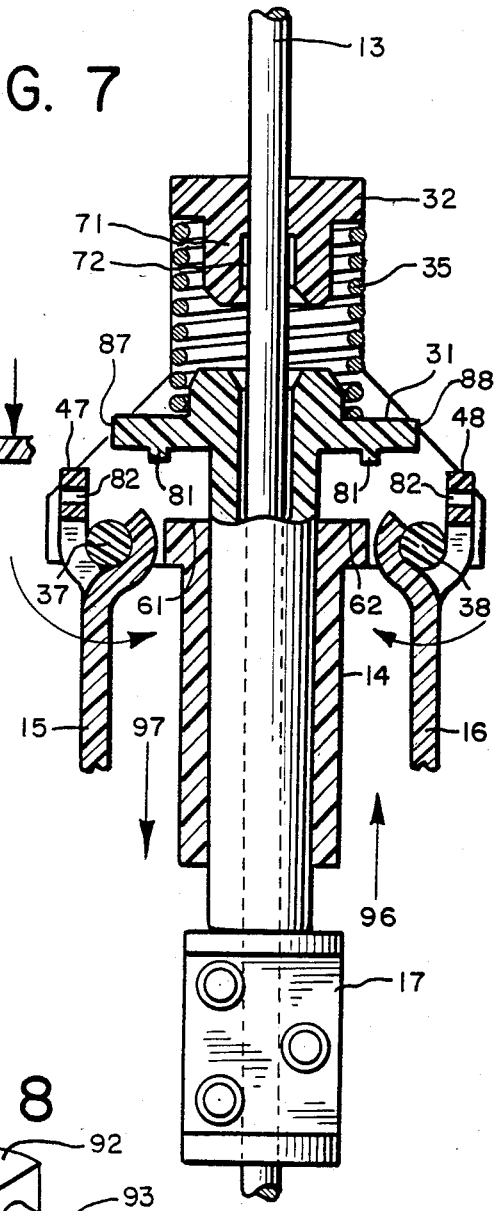
FIG. 7 is a view similar to FIG. 6 wherein the wings have been released to the descending position.

With the wings held in this ascending position, the device is ready to be released by the kite flier. Once released, the device is pushed up the kite string 13 by wind forces represented by arrows 95. The device continues up the kite string toward the kite until the the elongate portion 34 of the trigger means 50 engages the stop 17. At this point, as shown in FIG. 7, the progress of the trigger means 50 is stopped and the housing means 14 and wings 15 and 16 continue to move forward a short distance toward the kite, thus compressing the spring 35. Having so moved in the direction indicated by the arrow 97, the shoulder surfaces 61 and 62 and the tabs 47 and 48 are brought away from the flanged portion 31. As a result, the tabs are released and the wings are permitted to pivot in response to wind pressure toward the kite and into the descending position, i.e. generally parallel to the kite string.

For the sake of convenience and clarity in describing this action in both the specification and the claims, this motion is referred to as a relative motion by the trigger means. That is, it is deemed easier to think of and describe the trigger means as the element moving in the direction indicated by arrow 96, even thought it is actually stationary. Accordingly, at other points in the specification and claims, the action is described as a motion by the trigger means relative to the housing means and wings.

As the wings fold toward the kite, the wind pressure exerted on the device will be reduced and the spring 35 will cause the trigger means 50 to once again be fully inserted within the housing means 14. Accordingly, the flanged portion will be brought to a position adjacent to the shoulders 61 and 62 of the housing means 14. At this point however, the tabs 47 and 48 have swung out from between the flanged portion and the shoulders. As a result, instead of being locked in the ascending position, the wings will be locked in the descending position as the tabs 47 and 48 contact the edges of the flanged portion 87 and 88, respectively.

With the wings securely folded toward the kite, i.e. in the descending position, they will catch considerably less wind pressure and the device will thereby be allowed to slide down the string responsive to gravity. After it has descended to the kite flyer, the wings can again be placed in the ascending position and the device can be sent back up the kite string.

In the preferred embodiment, when the trigger means is stopped, and as the housing means 14 continues to move toward the kite, this relative motion also causes the object, such as parachute 18, to be released from the device. Referring to FIGS. 4 and 5, this occurs as a result of the trigger means experiencing relative motion back into the housing means, i.e. the housing means continues forward when the trigger means is stopped by the stop 17, the rod 41 is separated from the tab 42 and the hook or eye of the object is released.

Figure 8:
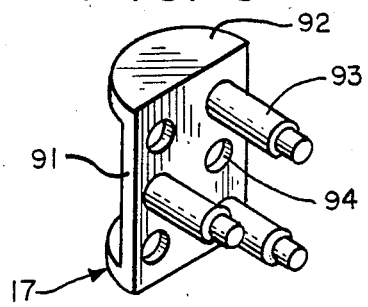
Figure 8A:
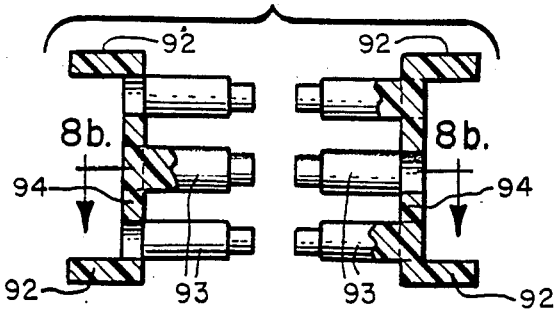
Figure 8B:
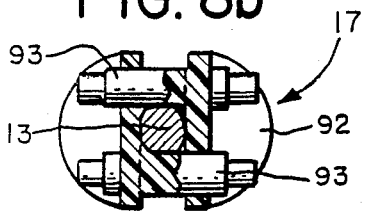

FIGS. 8, 8*a* and 8*b* shows the preferred configuration for the stop 17. Two identical sides 91 are provided, each of which comprise two semi-circular ends 92, three pegs 93, and three holes 94. The two sides 91 are pushed together with the string 13 between them. The size of the pegs 93 and the holes 94 are selected to effect sufficient frictional force to retain the two sides in the pushed together state. The stop 17 is relatively small, lightweight, and easy to affix to the kite string 13. In addition, it is adapted to be readily removable in order for it to be attached to different kite string.

It should be born in mind that the specific embodiments depicted and described herein have been provided by way of explanation and example. Certainly, embodiments with particular variations over those which have been shown herein will become apparent to those skilled in the art, and as such are considered within the scope of this invention as defined by the following claims.

What is claimed is:

1. A device for ascending a string toward a kite and subsequently descending the string comprising:

housing means with a longitudinal axis generally parallel to the kite string and an elongate aperture through the housing means and arranged generally parallel to the longitudinal axis;

a first and second wing each hingedly attached to the housing means and each being adapted to pivot between an ascending position generally transverse to the longitudinal axis of the device, and a descending position generally parallel to the longitudinal axis and toward the kite;

trigger means for releasably retaining each wing in its ascending position comprising an elongate portion inserted within the aperture of the housing means and adapted to move slidably therein and being of a length greater than the housing means so as to allow an end of the trigger means to extend beyond the housing means in the direction toward the kite when fully inserted, the trigger means also comprising an aperture passing through the trigger means and passing through the aperture of the housing means, which aperture is parallel to the longitudinal axis and is adapted to receive the kite string;

means for biasing the trigger means into the aperture of the housing means and toward the kite so as to retain each wing in the ascending position; and stop means located on the kite string whereby when the extending end of the trigger means contacts the stop means and the housing means is pushed further toward the kite, the trigger means experiences relative motion back into the housing means thus releasing each wing from its ascending position and allowing each wing to assume its descending position.

2. The device of claim 1 wherein the trigger means further comprises means for releasing an object in response to contact with the stop means.

3. The device of claim 2 wherein the means for releasing an object is located closer to the kite than are the wings.

4. The device of claim 2 wherein the means for releasing an object comprises a rod affixed to the trigger means which when the trigger means is fully inserted cooperates with a feature on the housing means to form a closed loop for holding the object, and, when the trigger means is pushed back relative to the housing means, the rod moves away from the feature on the housing means and opens the loop thereby releasing the object.

5. The device of claim 4 wherein the rod affixed to the trigger means and the feature on the housing means are located closer to the kite than the wings.

6. The device of claim 2 wherein the object is a parachute.

7. The device of claim 1 wherein the means for biasing the trigger means comprises a spring.

8. A device for ascending a string toward a kite and subsequently descending the string comprising:

housing means with a longitudinal axis generally parallel to the kite string and comprising a base portion, and an elongate aperture through the housing means and arranged generally parallel to the longitudinal axis, the base portion including a first and second shoulder surface;

a first wing pivotally attached to a first side of the base portion, and having a tab means which, when pivoted to a position adjacent to said first shoulder surface, causes the first wing to be aligned in an ascending position generally transverse to the longitudinal axis of the device and which, when pivoted to a position away from said first shoulder surface, causes the first wing to be aligned in a descending position generally parallel to the longitudinal axis and toward the kite;

a second wing pivotally attached to a second side of the base portion, and having a tab means which, when pivoted to a position adjacent to said second shoulder surface, causes the second wing to be aligned in an ascending position generally transverse to the longitudinal axis of the device and which, when pivoted to a position away from said first shoulder surface, causes the second wing to be aligned in a descending position generally parallel to the longitudinal axis and toward the kite;

trigger means comprising an elongate portion inserted within the aperture of the housing means and adapted to move slidably therein and being of a length greater than the housing means so as to allow an end of the trigger means to extend beyond the housing means in the direction toward the kite when fully inserted, a flanged portion, and an aperture passing through the trigger means and passing through the aperture of the housing means, which aperture is parallel to the longitudinal axis and is adapted to receive the kite string;

means for biasing the trigger means into the aperture of the housing means and toward the kite so that, when the tab means of the first and second wings are in the position adjacent to the first and second shoulder surfaces respectively, the flanged portion of the trigger means pushes against an opposite side of each tab means and thereby retains each tab means adjacent to the respective shoulder surfaces so long as the trigger means is fully inserted, thus maintaining the first and second wings in the ascending position transverse to the longitudinal axis;

stop means located on the kite string whereby when the extending end of the trigger means contacts the stop means and the housing means is pushed further toward the kite, the trigger means experiences relative motion back into the housing means and the flanged portion is in turn pushed away from each of the tab means thereby allowing the tab means to pivot away from the first and second shoulder surface which results in the first and second wing being allowed to pivot to the descending position generaly parallel to the longitudinal axis.

9. The device of claim 8 wherein the means for biasing the trigger means comprises a spring.

10. The device of claim 8 wherein the trigger means further comprises means for releasing an object in response to contact with the stop means.

11. The device of claim 10 wherein the means for releasing an object is located closer to the kite than are the wings.

12. The device of claim 10 wherein the means for releasing an object comprises a rod affixed to the trigger means which when the trigger means is fully inserted cooperates with a feature on the housing means to form a closed loop for holding the object, and, when the trigger means is pushed back into and relative to the housing means, the rod moves away from the feature on the housing means and opens the loop, thereby releasing the object.

13. The device of claim 12 wherein the rod affixed to the trigger means and the feature on the housing means are located closer to the kite than the wings.

14. The device of claim 13 wherein the object is a parachute.

15. The device of claim 8 wherein aperture in the housing means and the elongate portion of the trigger means are both cylindrical.

16. The device of claim 15 wherein the aperture in the trigger means passes through the center of both cylinders.

17. The device of claim 8 wherein the stop means, housing means, wings, and the trigger means are all molded plastic.

18. The device of claim 17 wherein the stop means, housing means, and the trigger means are all molded from the same piece of plastic.

* * * * *